US011316250B2

(12) United States Patent
An et al.

(10) Patent No.: US 11,316,250 B2
(45) Date of Patent: Apr. 26, 2022

(54) CHIP ANTENNA AND ANTENNA MODULE INCLUDING CHIP ANTENNA

(71) Applicant: Samsung Electro-Mechanics Co., Ltd., Suwon-si (KR)

(72) Inventors: Sung Yong An, Suwon-si (KR); Joong Jin Nam, Suwon-si (KR); Jae Yeong Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 17/022,239

(22) Filed: Sep. 16, 2020

(65) Prior Publication Data

US 2021/0384609 A1 Dec. 9, 2021

(30) Foreign Application Priority Data

Jun. 8, 2020 (KR) ..... 10-2020-0068918

(51) Int. Cl.
*H01Q 1/22* (2006.01)
*H01Q 1/38* (2006.01)
*H01Q 9/04* (2006.01)

(52) U.S. Cl.
CPC ..... *H01Q 1/2283* (2013.01); *H01Q 1/38* (2013.01); *H01Q 9/045* (2013.01); *H01Q 9/0414* (2013.01)

(58) Field of Classification Search
CPC ..... H01Q 1/2283; H01Q 1/38; H01Q 9/0414; H01Q 9/045
USPC ..... 343/702
See application file for complete search history.

(56) References Cited

U.S. PATENT DOCUMENTS

2011/0019263 A1* 1/2011 Cha ..... G02B 26/026 359/296
2020/0203801 A1* 6/2020 Im ..... H01Q 9/045

FOREIGN PATENT DOCUMENTS

JP 2002-100698 A 4/2002
KR 10-2007-0046420 A 5/2007
KR 10-1974548 B1 5/2019

* cited by examiner

*Primary Examiner* — Peguy Jean Pierre
(74) *Attorney, Agent, or Firm* — NSIP Law

(57) ABSTRACT

A chip antenna is provided. The chip antenna includes a first dielectric layer; a second dielectric layer disposed on an upper surface of the first dielectric layer; a patch antenna pattern disposed in the second dielectric layer; first and second feed vias disposed to penetrate through at least one of the first and second dielectric layers, respectively and electrically connected to a corresponding feed point among different first and second feed points of the patch antenna pattern; and first and second filters disposed between the first and second dielectric layers, respectively and electrically connected to a corresponding feed via among the first and second feed vias.

17 Claims, 10 Drawing Sheets

CHIP ANTENNA AND ANTENNA MODULE INCLUDING CHIP ANTENNA

CROSS-REFERENCE TO RELATED APPLICATION(S)

This application claims the benefit under 35 USC § 119(a) of priority to Korean Patent Application No. 10-2020-0068918, filed on Jun. 8, 2020, in the Korean Intellectual Property Office, the entire disclosure of which is incorporated herein by reference for all purposes.

BACKGROUND

1. Field

The following description relates to a chip antenna and an antenna module including the chip antenna.

2. Description of Related Art

Mobile communications data traffic has been increasing rapidly over recent years. Technology has been actively developed to support such rapid data transfer or data traffic in real time in a wireless network. In an example, applications such as applications related to the contents of Internet of Things (IoT)-based data, augmented reality (AR), Virtual Reality (VR), live VR/AR combined with SNS, autonomous driving, Sync View (real-time image transmission from the user's point view using an ultra-small camera), and the like, may utilize communications, (for example, 5G communications, millimeter wave (mmWave) communications, and the like), that support the transmission and reception of large amounts of data.

An RF signal in a high frequency band (for example, 24 GHz, 28 GHz, 36 GHz, 39 GHz, 60 GHz, and the like) may be easily absorbed in a process of transmission, and may result in data loss. Accordingly, the quality of communications may be dramatically reduced. Thus, an antenna that is configured to communicate in a high frequency band may be implemented by an approach that is different from the typical antenna technology. Technological aspects such as additional power amplifiers that ensure antenna gain, the integration of an antenna and an RFIC, and effective isotropic radiated power (EIRP) may be necessary to reduce data loss.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a chip antenna includes a first dielectric layer; a second dielectric layer disposed on an upper surface of the first dielectric layer; a patch antenna pattern disposed in the second dielectric layer; a first feed via and a second feed via respectively disposed to penetrate through at least one of the first dielectric layer and the second dielectric layer, and electrically connected to a corresponding feed point among a first feed point and a second feed point of the patch antenna pattern; and a first filter and a second filter disposed between the first dielectric layer and the second dielectric layer, and electrically connected to a corresponding feed via among the first feed via and the second feed via.

The chip antenna may include a first ground layer disposed between the first filter and the second filter and the patch antenna pattern, wherein the first ground layer is configured to have a first hole and a second hole in which the first feed via and the second feed vias are respectively located.

The chip antenna may include a second ground layer disposed on a lower surface of the first dielectric layer, wherein the second ground layer is configured to have a third hole and a fourth hole in which the first feed via and the second feed via are respectively located.

The chip antenna may include a ground layer disposed to be spaced apart upwardly or downwardly of the first filter and the second filter; and a first ground via and a second ground via electrically connected between the ground layer and a corresponding filter among the first filter and the second filter.

Each of the first filter and the second filter may include a first ring pattern having a first port, and configured to surround a first area; and a second ring pattern having a second port, and configured to surround a second area, wherein one of the first port and the second port is connected to a corresponding feed via among the first feed via and the second feed via, and another of the first port and the second port is connected to a corresponding ground via among the first ground via and the second ground via.

Each of the first filter and the second filter may include a first ring pattern having a first port and surrounding a first area; and a second ring pattern having a second port and surrounding a second area, and wherein at least one of the first port and the second port is connected to a corresponding feed via among the first feed via and the second feed via.

The first ring pattern and the second ring pattern may be disposed to be spaced apart from each other, and have an open shape in a direction facing each other.

The first filter may be disposed such that the first ring pattern and the second ring pattern protrude from the first port and the second port in a first direction, and the second filter may be disposed such that the first ring pattern and the second ring pattern protrude from the first port and the second port in a second direction, different from the first direction.

The chip antenna may include an adhesive layer configured to adhere between the first dielectric layer and the second dielectric layer.

The adhesive layer may be configured to have a cavity to surround the first filter and the second filter.

The adhesive layer may be configured to have a ventilator between the cavity and an outer surface of the adhesive layer.

The first dielectric layer and the second dielectric layer may be respectively comprised of a ceramic material, and the adhesive layer may include a polymer.

The chip antenna may include a soldering pattern disposed on a lower surface of the first dielectric layer and arranged along an outer periphery of the first dielectric layer.

In a general aspect, an antenna module includes a substrate, in which at least one wiring layer and at least one insulating layer are alternately stacked; and a chip antenna disposed on a first surface of the substrate, wherein the chip antenna comprises a first dielectric layer, configured to have a higher dielectric constant than a dielectric constant of the at least one insulating layer; a second dielectric layer, disposed on an upper surface of the first dielectric layer, and configured to have a higher dielectric constant than the dielectric constant of the at least one insulating layer; a patch antenna pattern disposed in the second dielectric layer; a feed via disposed to penetrate through at least one of the first dielectric layer and the second dielectric layer, and electrically connected between the patch antenna pattern and the at least one wiring layer; and a filter, disposed between the first dielectric layer and the second dielectric layer and electrically connected to the feed via.

The filter may include a first ring pattern having a first port and surrounding a first area; and a second ring pattern having a second port and surrounding a second area, and wherein at least one of the first port and the second port is electrically connected to the feed via.

The chip antenna further comprises a ground layer, disposed to be spaced apart upwardly or downwardly of the filter; and a ground via electrically connected between the ground layer and the filter.

In a general aspect, an electronic device includes a base substrate comprising: a communication modem; a baseband integrated circuit (IC), and at least one antenna module; the at least one antenna module includes a substrate; a chip antenna, disposed on an upper surface of the substrate; an integrated circuit, disposed on a lower surface of the substrate; wherein the chip antenna includes a first dielectric layer, disposed adjacent to an upper surface of the substrate; a filter, disposed on an upper surface of the first dielectric layer; a second dielectric layer disposed above the filter, and a feed via, configured to penetrate the first dielectric layer and the second dielectric layer, and further configured to electrically connect the chip antenna and the integrated circuit.

The substrate may include one or more alternately stacked wiring layers, and one or more alternately stacked insulating layers.

The first dielectric layer and the second dielectric layer may have a higher dielectric constant than a dielectric constant of the insulating layers.

Other features and aspects will be apparent from the following detailed description, the drawings, and the claims.

Figure 1A:
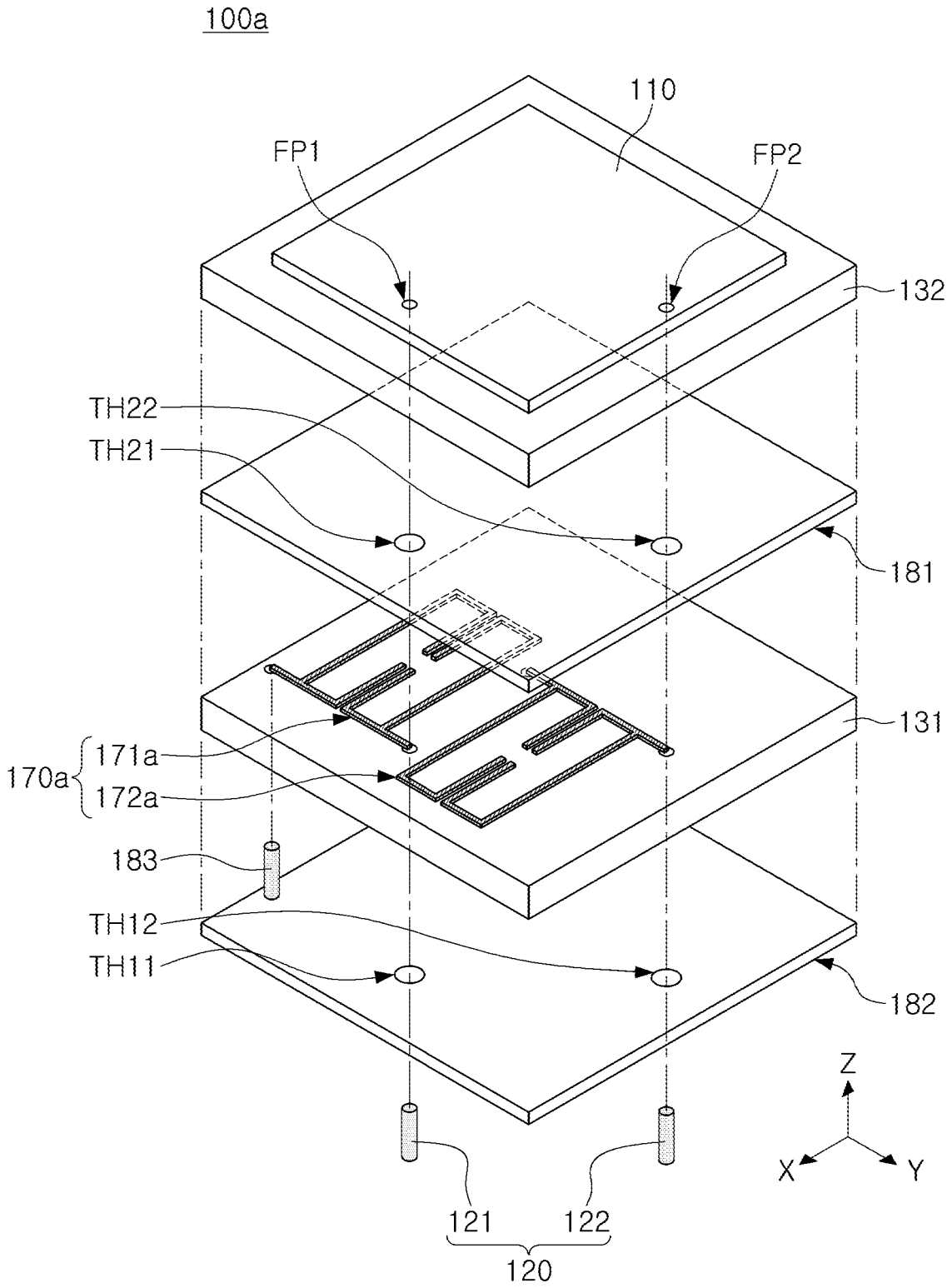
FIGS. 1A and 1B are perspective views illustrating an example structure of a chip antenna, in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Unless otherwise defined, all terms, including technical and scientific terms, used herein have the same meaning as commonly understood by one of ordinary skill in the art to which this disclosure pertains after an understanding of the disclosure of this application. Terms, such as those defined in commonly used dictionaries, are to be interpreted as having a meaning that is consistent with their meaning in the context of the relevant art and the disclosure of the present application, and are not to be interpreted in an idealized or overly formal sense unless expressly so defined herein.

Figure 1B:
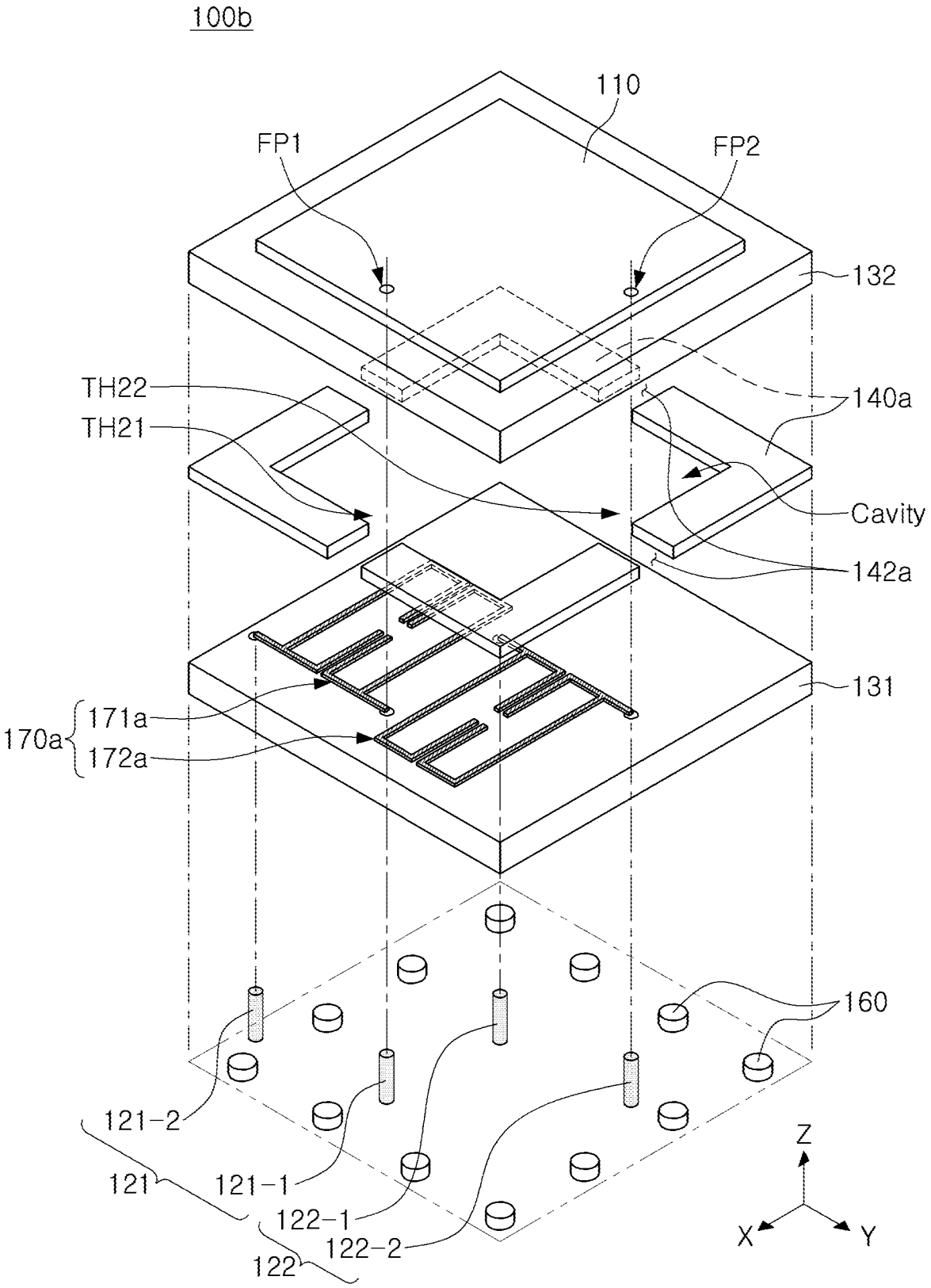

FIGS. 1A and 1B are perspective views illustrating a structure of an example chip antenna, in accordance with one or more embodiments.

Referring to FIGS. 1A and 1B, example chip antennas 100*a* and 100*b*, in accordance with one or more embodiments, may include a first dielectric layer 131, a second dielectric layer 132, a patch antenna pattern 110, and a feed via 120, and a filter 170*a*.

In an example, the first and second dielectric layers 131 and 132 may each have a dielectric medium having a higher dielectric constant than air. In an example, the first and second dielectric layers 131 and 132 may be formed of ceramic, and may thus have a higher dielectric constant than that of an insulating layer (e.g., prepreg) of the substrate. The ceramic formation of the first and second dielectric layers 131 and 132 is only an example, and other materials may be used.

The chip of the chip antenna 100*a* means that the chip antenna 100*a* is a component that can be separately manufactured and disposed on a substrate providing a dispositional space of the chip antenna 100*a*, and may be disposed on the structure. Accordingly, the first and second dielectric layers 131 and 132 may be formed of a material different from an insulating layer of the substrate 200 (FIG. 4), and may be implemented in a more diverse and freely selected manner than the insulating layer.

In an example, the first and second dielectric layers 131 and 132 may be formed of a ceramic-based material such as low-temperature co-fired ceramic (LTCC), or a material having a relatively high dielectric constant, such as a glass-based material, or a material such as teflon, and may further contain at least one of magnesium (Mg), silicon (Si), aluminum (Al), calcium (Ca), and titanium (Ti), such that it may be configured to have higher dielectric constant or stronger durability. In an example, the first and second dielectric layers 131 and 132 may include $Mg_2SiO_4$, $MgAlO_4$, and $CaTiO_3$.

The higher the dielectric constants of the first and second dielectric layers 131 and 132, the shorter the wavelength of a radio frequency (RF) signal transmitted or propagated around the first and second dielectric layers 131 and 132. The shorter the wavelength of the RF signal, the smaller the size of the first and second dielectric layers 131 and 132, and the smaller the size of the chip antenna 100*a* according to an embodiment of the present disclosure.

The smaller the size of the chip antenna 100*a*, the greater the number of chip antennas 100*a* that can be arranged in a unit volume. The greater the number of chip antennas 100*a* that can be arranged in a unit volume, the higher the total gain and/or maximum output power compared to the unit volume of the plurality of chip antennas 100*a*.

Therefore, the higher the dielectric constants of the first and second dielectric layers 131 and 132, the greater the efficiency of size-to-size performance of the chip antenna 100*a* may be effectively improved.

In an example, the first and second dielectric layers 131 and 132 may be disposed to be spaced apart from each other. Accordingly, the space between the first and second dielectric layers 131 and 132 may be comprised of air or a medium lower than the dielectric constant of the first and second dielectric layers 131 and 132.

Accordingly, a space between the first and second dielectric layers 131 and 132 and a boundary surface between the first dielectric layers 131 may achieve a first dielectric boundary condition, and a space between the first and second dielectric layers 131 and 132 and a boundary surface between the second dielectric layers 132 may achieve a second dielectric boundary condition.

Since the first and second dielectric boundary conditions may refract a propagation direction of an RF signal, the first and second dielectric boundary conditions may more effectively concentrate a radiation pattern of the patch antenna pattern 110 in a vertical direction (for example, a z direction), and may improve a gain of the chip antenna 100*a*.

In a non-limiting example, the patch antenna pattern 110 may be disposed on the second dielectric layer 132. A relatively wide upper surface of the patch antenna pattern 110 may concentrate a radiation pattern in a vertical direction (for example, a z direction), so that a RF signal can be remotely transmitted and/or received in the vertical direction, and a RF signal having a frequency within a bandwidth based on a resonance frequency of the patch antenna pattern 110 may be remotely transmitted and/or received.

In an example, the shape of the patch antenna pattern 110 may be polygonal or circular, and the patch antenna pattern 110 may be configured to be a plurality of patch antenna patterns disposed to overlap each other in the vertical direction (e.g., the z direction). The sizes of the plurality of patch antenna patterns 110 may be different from each other, and may be electromagnetically coupled to each other. When the number of patch antenna patterns 110 increases, the number of the second dielectric layers 132 may also increase. In an example, the plurality of patch antenna patterns 110 and the plurality of second dielectric layers 132 may be alternately stacked vertically. In an example, one of the plurality of patch antenna patterns 110 may be a radiator, and the other thereof may have a relatively small size to feed the radiator in a non-contact manner.

In an example, the patch antenna pattern 110 may be formed as a conductive paste, and may be applied on the second dielectric layer 132 and dried.

The feed via 120 may be disposed to penetrate through the first dielectric layer 131, and may serve as a feed path of the patch antenna pattern 110. That is, the feed via 120 may provide a path through which a surface current flowing in the patch antenna pattern 110 flows when the patch antenna pattern 110*a* remotely transmits and/or receives an RF signal.

In an example, the feed via 120 may have a structure extending vertically in the first dielectric layer 131, and may be formed through a process in which a conductive material (e.g., copper, nickel, tin, silver, gold, palladium, and the like) is filled in a through hole by a laser.

The feed via 120 may include a first feed via 121 and a second feed via 122. The first and second feed vias 121 and 122 may be disposed to penetrate through at least one of the first and second dielectric layers 131 and 132, respectively, and may be electrically connected to different first and second feed points FP1 and FP2 of the patch antenna pattern 110.

The first feed via 121 may provide a transmission/reception path of a first RF signal, and the second feed via 122 may provide a transmission/reception path of a second RF signal. The first RF signal may carry first communication information, and the second RF signal may carry second communication information.

Since the chip antenna 100*a* according to an embodiment can remotely transmit and receive the first and second RF signals through the first and second feed vias 121 and 122 simultaneously, it may have a higher data transmission rate.

The first feed via 121 may be connected by being biased in a first direction (e.g., an x direction) from a center of the patch antenna pattern 110, and the second feed via 122 may be connected by being biased in a second direction (e.g., a y direction) different from the first direction from the center of the patch antenna pattern 110.

Accordingly, a first surface current corresponding to the first RF signal transmitted through the first feed via 121, may flow in the first direction from the patch antenna pattern 110, and a second surface current corresponding to the second RF signal transmitted through the second feed via 122 may flow from the patch antenna pattern 110 in a second direction.

Assuming that the first and second directions are perpendicular to each other, a first electric field and a first magnetic field of the first RF signal that radiates based on the first surface current, may be formed in the first direction and the second direction, respectively, and a second electric field and a second magnetic field of the second RF signal that radiates based on the second surface current may be formed in the second direction and the first direction, respectively.

Accordingly, the first and second RF signals can be radiated without substantial interference and cancellation with respect to each other, and the chip antenna 100*a* according to an example may improve comprehensive gains of the first and second RF signals.

A filter 170*a* may be disposed between the first and second dielectric layers 131 and 132, and can be electrically connected to the feed via 120.

The filter 170*a* may have a resonance frequency close to a fundamental frequency (e.g., 28 GHz, 39 GHz) of the RF signal remotely transmitted and received from the patch antenna pattern 110, and may have a band to which the fundamental frequency of the RF signal belongs. The resonance frequency may be determined according to a combination in inductance and capacitance of the filter 170*a*.

For example, the filter 170*a* may pass a frequency component in a band and block the remaining frequency components when it has a band pass characteristic, and block a frequency component in a band and block the remaining frequency components when it has a band block characteristic.

When the filter 170*a* is connected in series with the transmission/reception path of the RF signal, the filter 170*a* may reflect frequency components to be blocked to be filtered.

When the filter 170*a* is connected to the transmission/reception path of the RF signal by a shunt connection, the filter 170*a* may transmit the frequency component passed by the filter 170*a* to the first and/or second ground layers 181 and 182 to be filtered.

Since the filter 170*a* may filter harmonics and/or noise included in the RF signal, interference between the chip antenna 100*a* and an adjacent antenna according to an example may be reduced, and interference between a communication channel of the chip antenna 100*a* (e.g., a 5G communications channel, a millimeter wave communications channel) and a communications channel of adjacent channels (e.g., LTE) may be reduced, and it can help to comply with an electromagnetic compatibility (EMC) standard of the electronic device in which the chip antenna 100*a* is disposed.

Since the harmonics and/or noise included in the RF signal may be introduced into the RF signal according to remote transmission and reception in the patch antenna pattern 110, the filtering efficiency of the filter 170*a* may be more efficient closer to the patch antenna pattern 110.

Additionally, since energy of the RF signal may be lost according to the flow between the filter 170*a* and the patch antenna pattern 110, energy efficiency according to the filtering of the filter 170*a* may be higher as an electrical length between the filter 170*a* and the patch antenna pattern 110 is shorter.

Since the chip antenna 100*a* according to an example may include the patch antenna pattern 110 and the filter 170*a* together, it may be configured such that the patch antenna pattern 110 and the filter 170*a* are adjacent to each other, and the filtering efficiency and energy efficiency of the filter 170*a* may be improved.

Additionally, since the filter 170*a* may be disposed between the first and second dielectric layers 131 and 132, the filter 170*a* may have a further reduced size based on the relatively high dielectric constant of the first and second dielectric layers 131 and 132 (e.g., a high dielectric constant of the ceramic material). Therefore, the filter 170*a* may efficiently have a structure in which a plurality of filters are disposed in one layer.

The filter 170*a* may include a first filter 171*a* and a second filter 172*a*. The respective first and second filters 171*a* and 172*a* may be disposed between the first and second dielectric layers 131 and 132, respectively, and may be electrically connected to a corresponding feed via among the first and second feed vias 121 and 122.

Some components of the first RF signal transmitted and received through the first feed via 121 and some components of the second RF signal transmitted and received through the second feed via 122 may act as harmonics and/or noise with respect to each other.

The first and second filters 171*a* and 172*a* may filter harmonics and/or noise according to an influence of the first and second RF signals with respect to each other.

Accordingly, the chip antenna 100*a* according to an example may not only reduce interference between the chip antenna 100*a* and adjacent antennas, but may also further reduce interference of the first and second RF signals to each other, to improve comprehensive gains of the first and second RF signals.

In an example, the first and second filters 171*a* and 172*a* may be disposed on the same level as each other, or may be disposed on different levels.

Referring to FIG. 1A, the chip antenna 100*a* according to an embodiment of the present disclosure may further include at least one of a first ground layer 181, a second ground layer 182, and a ground via 183.

The first ground layer 181 may be disposed between the first and second filters 171*a* and 172*a* and the patch antenna 110.

Accordingly, electromagnetic interference between the first and second filters 171*a* and 172*a* and the patch antenna 110 with respect to each other can be reduced, and filtering efficiency of the first and second filters 171*a* and 172*a* and a gain of the patch antenna 110 can be improved.

The first ground layer 181 may have first and second holes TH21 and TH22 in which the first and second feed vias 121 and 122 are located, respectively, and may be spaced apart from the first and second feed vias 121 and 122.

The second ground layer 182 may be disposed on the lower surface of the first dielectric layer 131.

Accordingly, electromagnetic interference between the first and second filters 171*a* and 172*a* and a substrate with respect to each other can be reduced, so that the filtering efficiency of the first and second filters 171*a* and 172*a* can be improved.

The second ground layer 182 may have third and fourth holes TH11 and TH12 in which the respective first and second feed vias 121 and 122 are located, and may be spaced apart from the first and second feed vias 121 and 122.

The ground via 183 may electrically connect the first and/or second ground layers 181 and 182 and the first and second filters 171*a* and 172*a*.

Accordingly, the first and second filters 171*a* and 172*a* may be connected to the first and second feed vias 121 and 122 by a shunt connection, and may transmit harmonics and/or noise components mixed in the first and second RF signals flowing through the first and second feed vias 121 and 122 with respect to the first and second ground layers 181 and 182.

Referring to FIG. 1B, a chip antenna 100*b* according to an example may further include at least one of an adhesive layer 140*a* and a soldering pattern 160.

The adhesive layer 140*a* may be adhered to the first and second dielectric layers 131 and 132 between the first and second dielectric layers 131 and 132. Accordingly, a phenomenon in which one of the first and second dielectric layers 131 and 132 deviates may be suppressed, and a distance between the first and second dielectric layers 131 and 132 may be stably maintained.

The adhesive layer 140*a* may have a dielectric constant higher than a dielectric constant of air, and lower than a dielectric constant of the first and second dielectric layers 131 and 132. That is, when a dielectric constant of at least a portion of the space between the first and second dielectric layers 131 and 132 is lower than a dielectric constant of the adhesive layer 140*a*, a bandwidth and a gain, compared to the size of the chip antenna 100*b*, may be further improved.

Therefore, the adhesive layer 140*a* may have a cavity to surround the first and second filters 171*a* and 172*a*, and the cavity may provide a dielectric medium, lower than a dielectric medium of the adhesive layer 140*a* (e.g., air), such that it is possible to further improve a bandwidth and a gain compared to the size of the chip antenna 100*b*.

Since the dimensions or shape of the cavity may affect the resonant frequency or performance of the chip antenna 100*b*, the chip antenna 100*a* may have a structure that reduces a phenomenon in which the dimension or shape of the cavity deviates from the designed dimension or shape in the manufacturing process, so that performance may be more stably obtained.

Additionally, since the adhesive layer 140*a* may have a shorter width as the cavity is provided, the adhesive layer 140*a* may have a relatively floating structural stability compared to when the cavity 141 is not provided. Therefore, the chip antenna 100*b* may have a structure that reduces factors that physically affect the adhesive layer 140*a* in a manufacturing process thereof, so that performance can be more stably obtained.

Therefore, the adhesive layer 140*a* may have a ventilator 142*a* between the cavity and an outer surface of the adhesive layer 140*a*.

For example, in the manufacturing process of the chip antenna 100*b*, when the first and second dielectric layers 131 and 132 are bonded by the adhesive layer 140*a*, the chip antenna 100*b* may receive stress causing a change in volume of the cavity, and the cavity may distort the size or shape of the cavity or cause cracks in the first and second dielectric layers 131 and 132.

The ventilator 142*a* may reduce the influence of the stress on the chip antenna 100*b* by providing an air movement path of the cavity when the chip antenna 100*b* receives the stress that causes a change in volume of the cavity.

Accordingly, the chip antenna 100*b* according to an embodiment of the present disclosure may reduce a phenomenon in which dimensions or a shape of a cavity deviates from designed dimensions or a shape in a manufacturing process, or a factor physically affecting the adhesive layer 140*a*. Since it can be reduced, it is possible to more stably obtain improved performance (bandwidth and gain compared to size) based on the cavity.

In an example, the adhesive layer 140*a* may include a polymer having higher adhesion than the dielectric materials of the first and second dielectric layers 131 and 132. Since the adhesive polymer may have fluid characteristics compared to the ceramic structure, it may have an instability factor in the dimensions or shape of the cavity, the chip antenna 100*b* according to an example may include a ventilator 142*a*, so that it is possible to stably have a cavity of the adhesive layer 140*a* including an adhesive polymer having viscosity.

In an example, one outer surface of the adhesive layer 140*a*, one side surface of the first dielectric layer 131, and one side surface of the second dielectric layer 132 may form one plane. That is, the chip antenna 100*b* according to an example may have a form in which a side surface of the structure is cut in a structure in which the adhesive layer 140*a* is attached to the first and second dielectric layers 131 and 132.

In an example, the adhesive layer 140*a* may be disposed between the first ground layer 181 and the filter 170*a* illustrated in FIG. 1A. Accordingly, the adhesive layer 140*a* may stably support a spacing distance between the first ground layer 181 and the filter 170*a*.

In an example, a soldering pattern 160 may be disposed on a lower surface of the first dielectric layer 131, and may be arranged along an outer periphery of the first dielectric layer 131.

Accordingly, the chip antenna 100*b* may be more stably mounted on a substrate providing a dispositional space of the chip antenna 100*a*. The soldering pattern 160 may be electrically connected to the ground plane of the substrate.

In an example, the soldering pattern 160 may be configured to be advantageous for coupling to a tin-based solder having a relatively low melting point, and may be configured to facilitate coupling to the solder by including a tin plating layer and/or a nickel plating layer, and may have a structure in which a plurality of cylinders are arranged, but is not limited thereto.

Referring to FIG. 1B, the first feed via 121 may include a first-1 feed via 121-1 and a first-2 feed via 121-2, and the second feed via 122 may include a second-1 feed via 122-1 and a second-2 feed via 122-2.

The first-1 feed via 121-1 and the first-2 feed via 121-2 may be disposed so as not to overlap in the vertical direction (e.g., a z-direction), and the second-1 feed via 122-1 and the second-2 feed via 122-2 may be disposed so as not to overlap in the vertical direction (e.g., the z direction).

The first filter 171*a* may be electrically connected between the first-1 feed via 121-1 and the first-2 feed via 121-2, and the second filter 172*a* may be electrically connected between the second-1 feed via 122-1 and the second-2 feed via 122-2.

That is, the first filter 171*a* may be connected in series with the first feed via 121, and the second filter 172*a* may be connected in series with the second feed via 122.

Figure 2A:
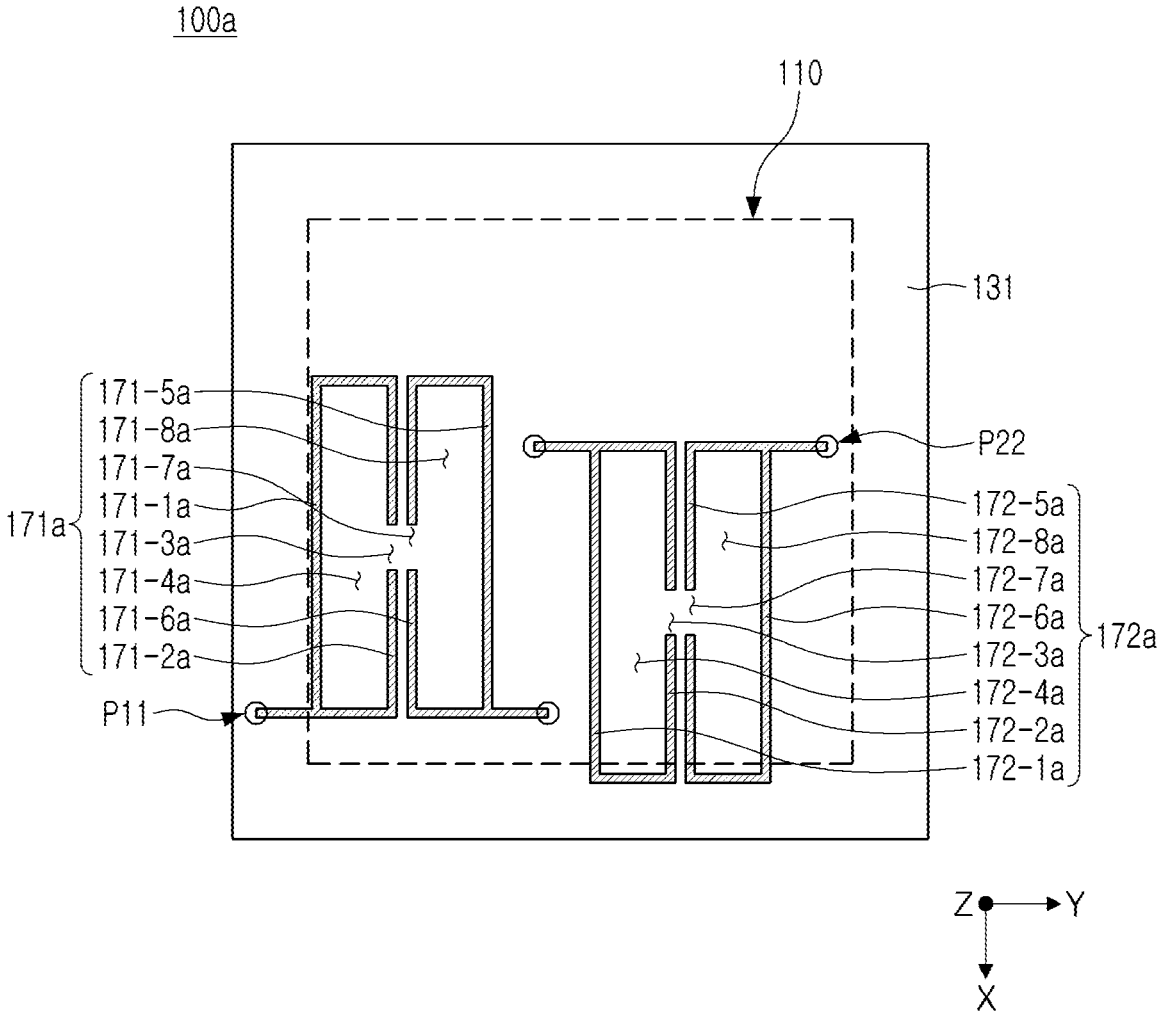
FIGS. 2A and 2B are plan views illustrating layers in which filters are disposed in an example chip antenna, in accordance with one or more embodiments.
Figure 2B:
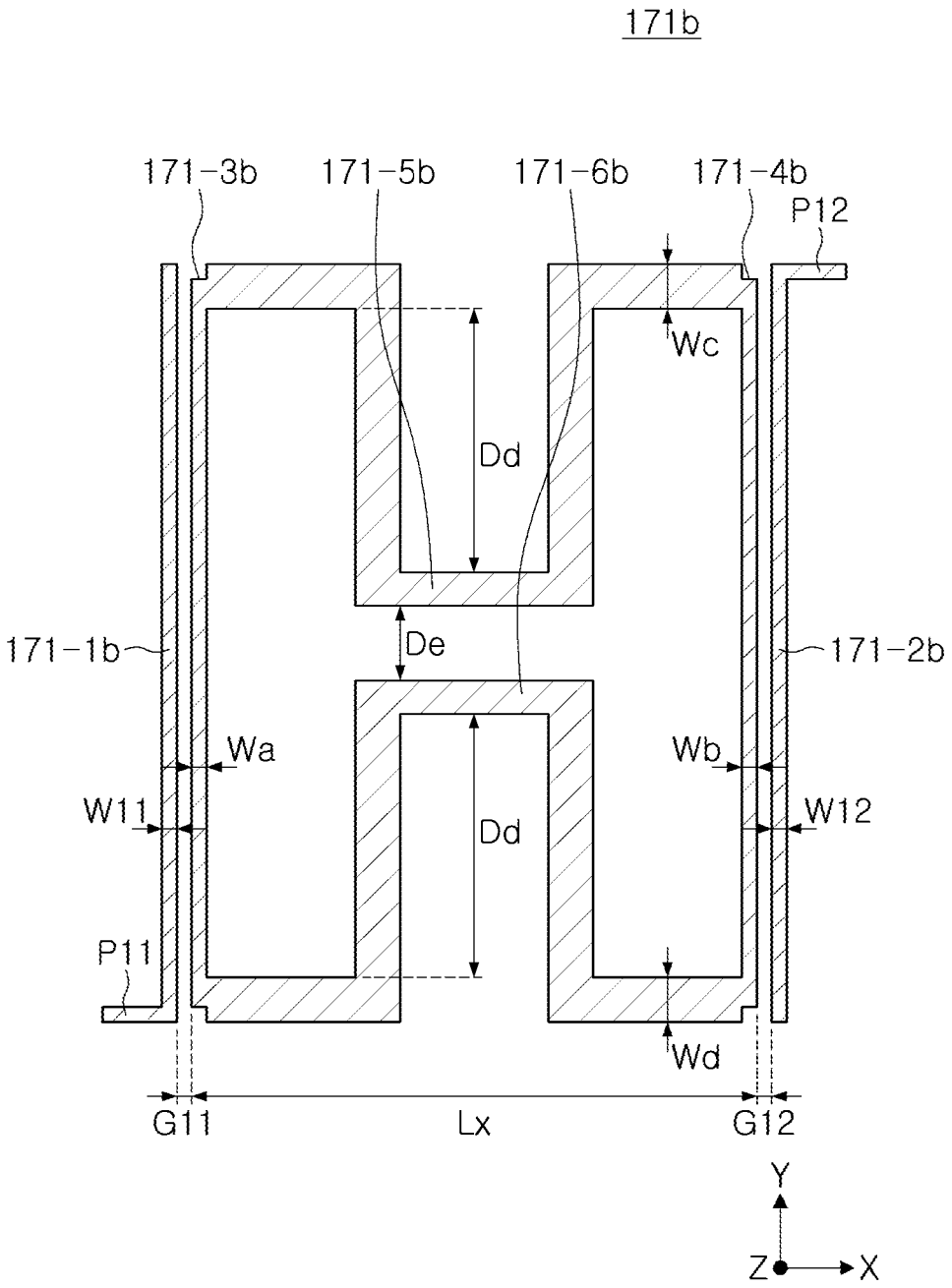

FIGS. 2A and 2B are plan views illustrating a layer on which a filter is disposed in the chip antenna according to an example.

Referring to FIG. 2A, the first filter 171*a* may include first ring patterns 171-1*a* and 171-2*a* and second ring patterns 171-5*a* and 171-6*a*, and the second filter 172*a* may include first ring patterns 172-1*a* and 172-2*a* and second ring patterns 172-5*a* and 172-6*a*.

In an example, the first ring patterns 171-1*a*, 171-2*a*, 172-1*a*, and 172-2*a* may have a shape having a first port P11 and surrounding first areas 171-4*a* and 172-4*a*.

In an example, the second ring patterns 171-5*a*, 171-6*a*, 172-5*a*, and 172-6*a* may have a shape having a second port P22 and surrounding second areas 171-8*a* and 172-8*a*.

Accordingly, the respective first and second filters 171*a* and 172*a* may have high inductance, compared to a size thereof, such that the first and second filters 171*a* and 172*a* may have a more efficiently designed resonance frequency.

One of the first and second ports P11 and P12 may be connected to a feed via, and the other thereof may be connected to a ground via. Accordingly, the first and second filters 171*a* and 172*a* may be connected to the feed via respectively, by a shunt connection.

The first ring patterns 171-1*a*, 171-2*a*, 172-1*a*, and 172-2*a* and the second ring patterns 171-5*a*, 171-6*a*, 172-5*a*, and 172-6*a* may be disposed to be spaced apart from each other, and may have an open shape in a direction facing each other. In an example, the first filter 171*a* may have first openings 171-3*a* and 171-7*a*, and the second filter 172*a* may have second openings 172-3*a* and 172-7*a*.

Accordingly, the first and second filters 171*a* and 172*a* may have a high capacitance, respectively, compared to a size thereof, such that the first and second filters 171*a* and 172*a* may have a more efficiently designed resonance frequency.

The first filter 171*a* may be disposed such that the first ring patterns 171-1*a* and 171-2*a* and the second ring patterns 171-5*a* and 171-6*a* protrude in a first direction (for example:−x direction), and the second filter 172*a* may be disposed such that the second ring patterns 172-5*a* and 172-6*a* protrude in a second direction (for example: +x direction).

Referring again to FIG. 2A, the first filter 171*b* may include a first extension pattern 171-1*b*, a second extension pattern 171-2*b*, and third ring patterns 171-3*b*, 171-4*b*, 171-5*b*, and 171-6*b*, and may be included in a chip antenna according to an example. The second filter included in the chip antenna may have the same shape as the first filter 171*b*.

Accordingly, the first filter 171*b* may have a larger inductance and/or capacitance compared to a size thereof, such that the first filter 171*b* may have a more efficiently designed resonance frequency.

Referring to FIG. 2B, the first extension pattern 171-1*b* may have a first width W11, the second extension pattern 171-2*b* may have a second width W12, and the third ring pattern 171-3*b*, 171-4*b*, 171-5*b*, and 171-6*b* may have third widths Wa, Wb, Wc, and Wd.

The first extension pattern 171-1*b* may be spaced apart from the third ring patterns 171-3*b*, 171-4*b*, 171-5*b*, and 171-6*b* by a first distance G11, and the second extension pattern 171-2*b* may be spaced apart from the third ring patterns 171-3*b*, 171-4*b*, 171-5*b*, and 171-6*b* by a second distance G12.

The third ring patterns 171-3*b*, 171-4*b*, 171-5*b*, and 171-6*b* may have a length in a direction (Lx) in a X direction, may be longer than a first length (Dd), and may form an internal space of a second length (De).

FIGS. 3A to 3E are perspective views illustrating a structure in which a portion in which a first filter is not disposed, is cut in a chip antenna, in accordance with one or more embodiments.

Figure 3A:
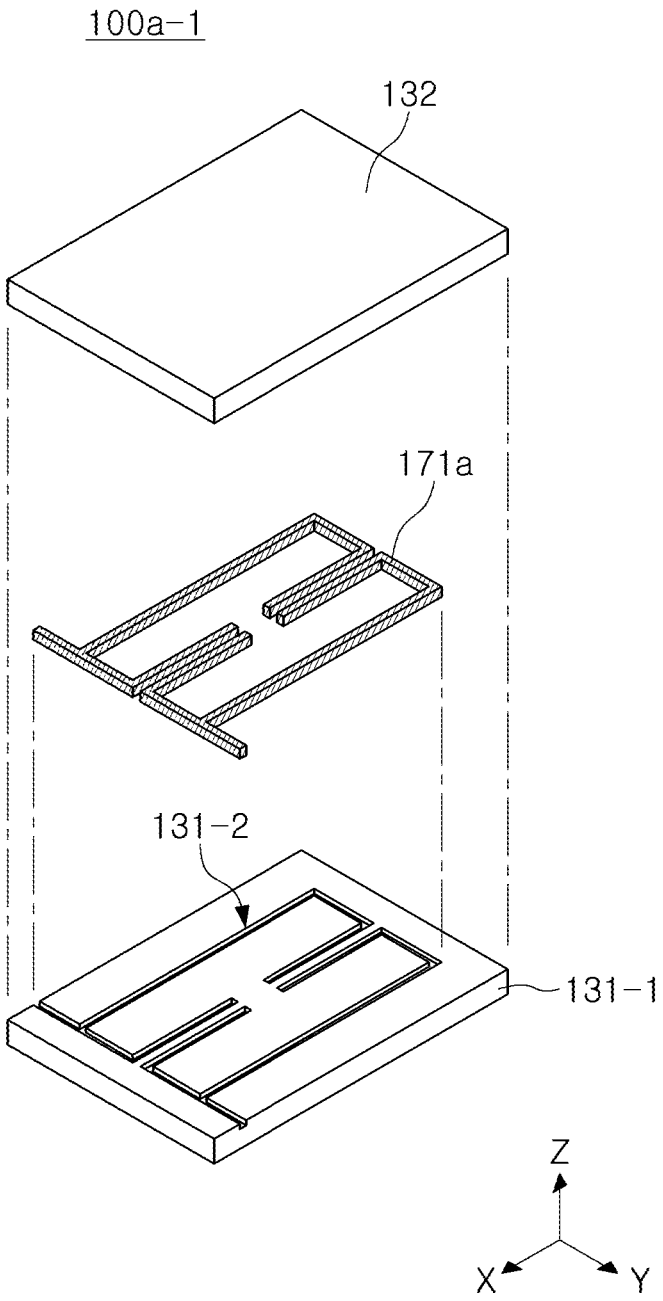
FIGS. 3A to 3E are perspective views illustrating a structure in which a portion in which a first filter is not disposed is cut in an example chip antenna, in accordance with one or more embodiments.

Referring to FIG. 3A, the chip antenna 100*a*-1 may include a first dielectric layer 131-1 having a dispositional space 131-2 that includes the first filter 171*a*.

Figure 3B:
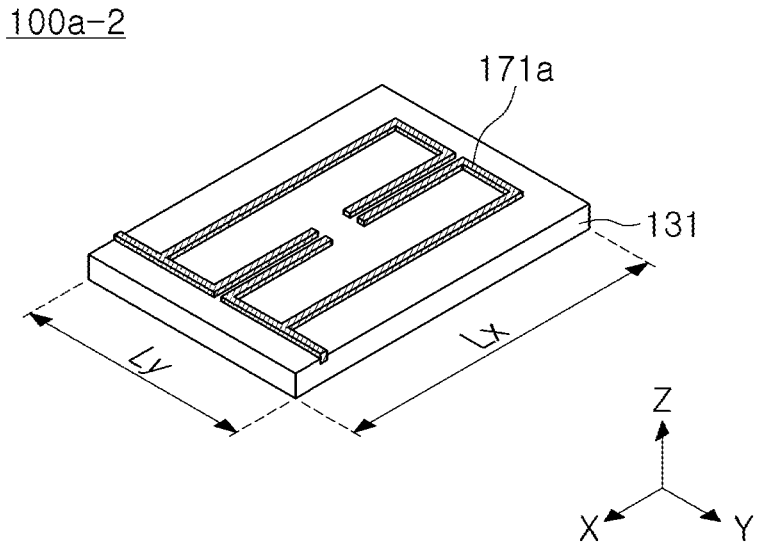

Referring to FIG. 3B, the chip antenna 100*a*-2 may include a first dielectric layer 131 having a length Ly in an x-direction and a length Lx in a y-direction.

Figure 3C:
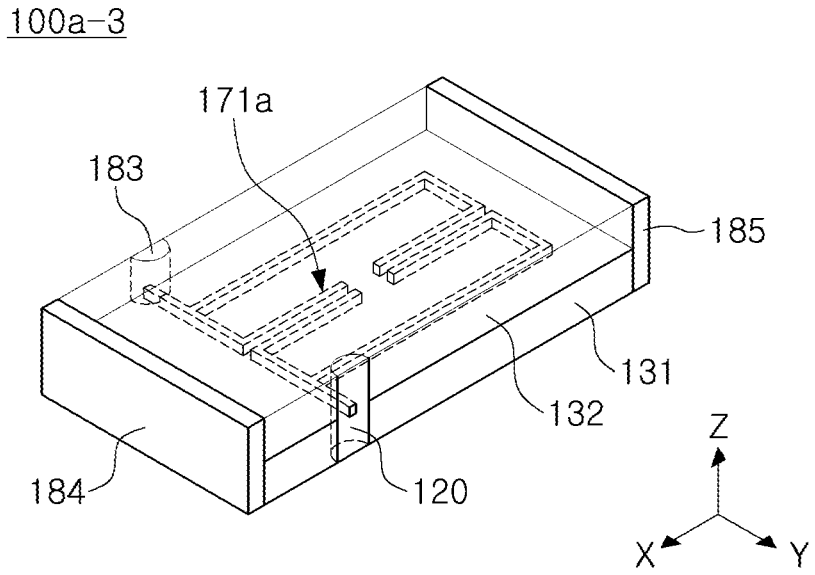
Figure 3D:
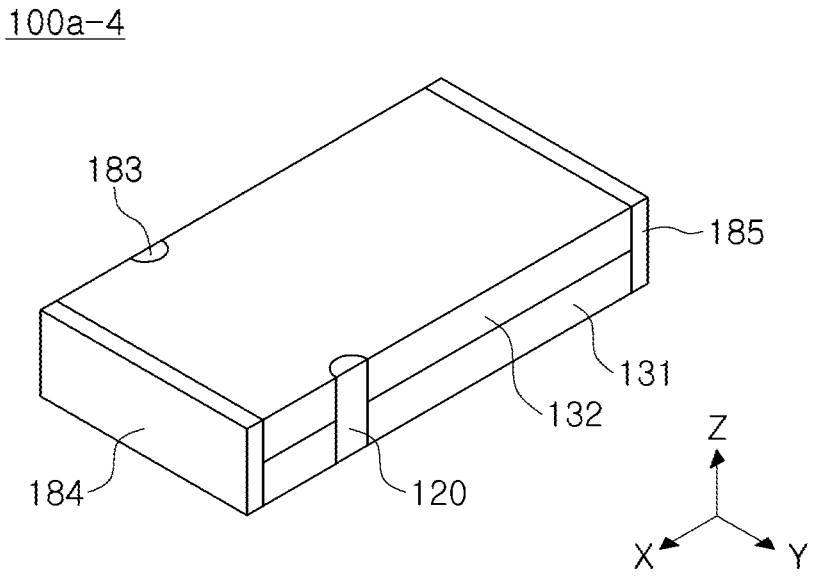

Referring to FIGS. 3C and 3D, the chip antennas 100*a*-3 and 100*a*-4 may include a first filter 171*a* electrically connected between the feed via 120 and the ground via 183, and may include first and second side surface ground members 184 and 185 disposed on side surfaces of the first and second dielectric layers 131 and 132 in an x direction.

Figure 3E:
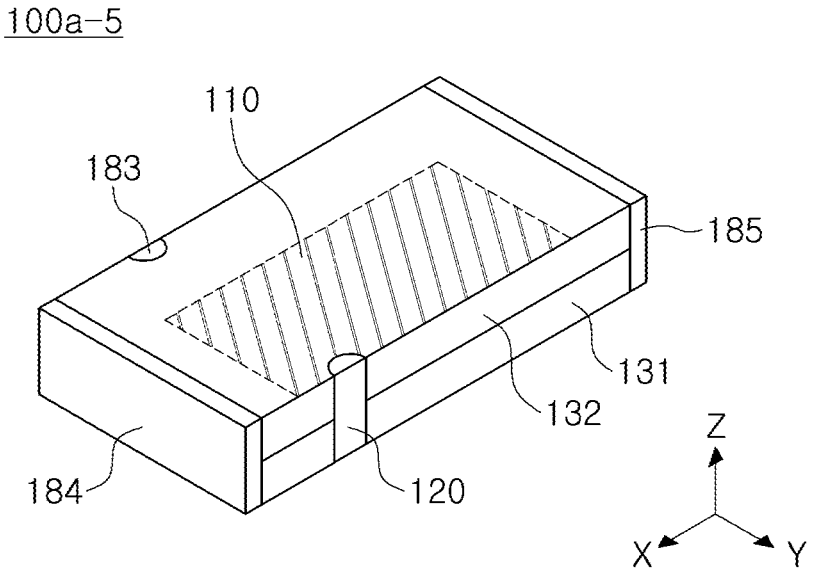

Referring to FIG. 3E, a chip antenna 100*a*-5 may include a patch antenna pattern 110 disposed on an upper surface of the second dielectric layer 132.

Figure 4:
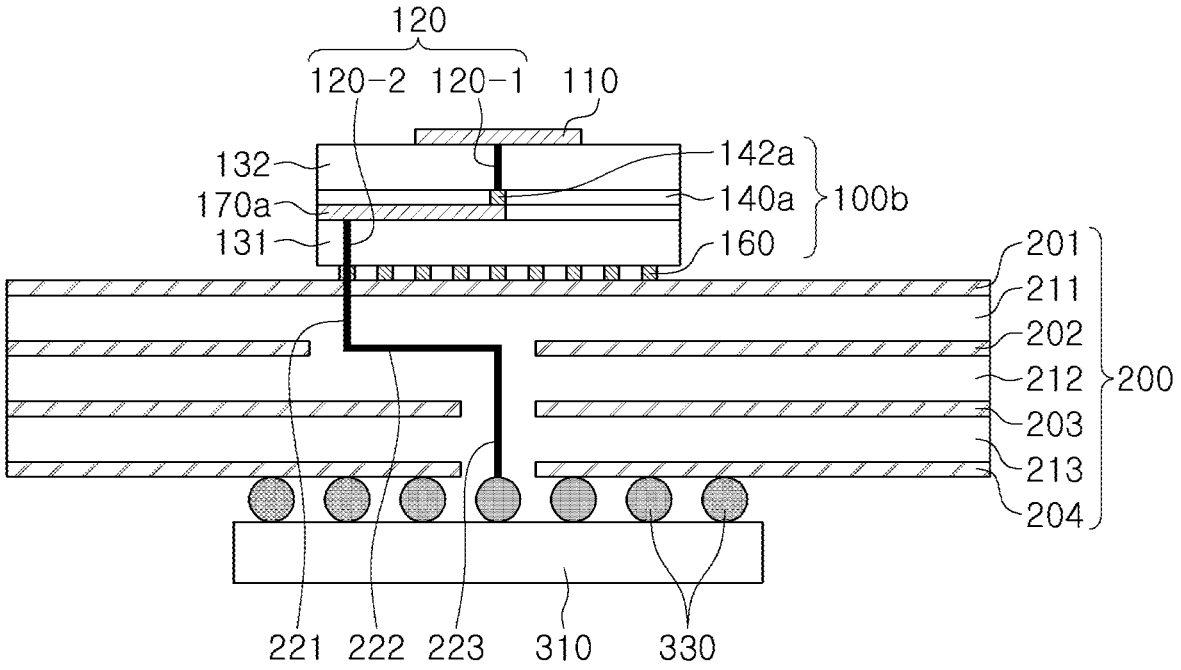
FIG. 4 is a side view illustrating an example chip antenna and an example antenna module including the same, in accordance with one or more embodiments.

FIG. 4 is a side view illustrating a chip antenna and an antenna module including the same, in accordance with one or more embodiments.

Referring to FIG. 4, a chip antenna 100*b*, in accordance with one or more embodiments, may be disposed on one surface (e.g., an upper surface) of the substrate 200, and may be mounted on the substrate 200 through a soldering pattern 160.

The substrate 200 may have a structure in which at least one of the wiring layers 201, 202, 203, and 204, are alternately stacked, and may have a structure in which at least one of the insulating layers 211, 212, and 213 are alternately stacked, and a structure, similar to the structure of the printed circuit board.

The wiring layer 202 may surround a wiring 222 included in the substrate 200, and the insulating layers 211, 212 and 213 may surround vias 221 and 223 included in the substrate 200. The vias 221 and 223 and the wiring 222 may electrically connect feed vias 120-1 and 120-2 of the chip antenna 100*b* and an integrated circuit (IC) 310.

The IC 310 may be mounted on the lower surface of the substrate 200 through an electrical connection structure 330.

First and second dielectric layers 131 and 132 of the chip antenna 100*b* may have a higher dielectric constant than a dielectric constant of at least one of the insulating layers 211, 212 and 213 of the substrate 200.

Accordingly, a filter 170*a* may have a more reduced size based on the high dielectric constants of the first and second dielectric layers 131 and 132, and may effectively have a structure in which a plurality of filters are disposed in one layer, and the total height of the chip antenna 100*b* may be reduced.

Figure 5A:
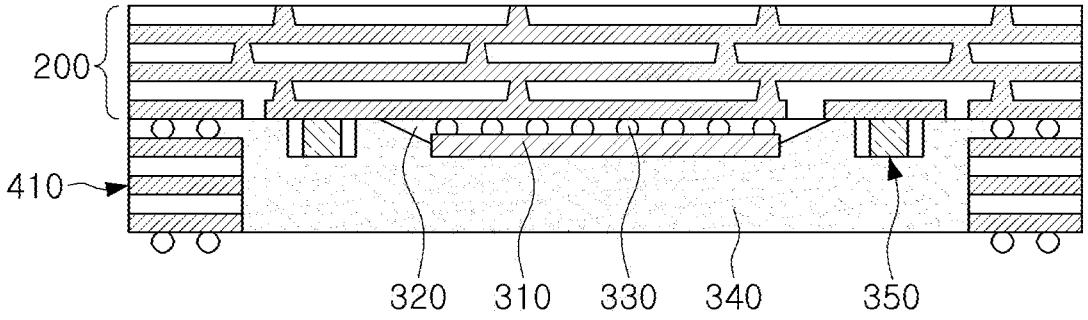
FIGS. 5A and 5B are side views illustrating a substrate providing a mounting space of an example chip antenna, in accordance with one or more embodiments.
Figure 5B:
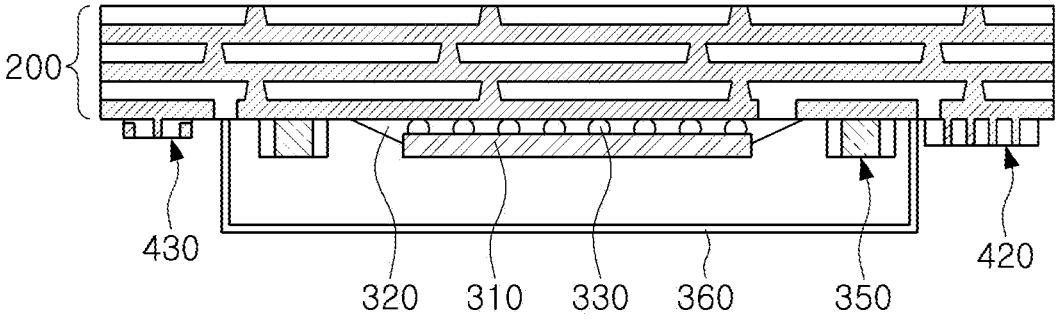

FIGS. 5A and 5B are side views illustrating a substrate providing a mounting space of a chip antenna according to an embodiment of the present disclosure.

Referring to FIG. 5A, a substrate 200, on which the chip antenna according to an example is mounted, may provide at least one dispositional space of an IC 310, an adhesive member 320, an electrical connection structure 330, an encapsulant 340, a passive component 350, and a core member 410.

The IC 310 may be disposed downwardly of the substrate 200, and the IC 310 may perform at least a portion of frequency conversion, amplification, filtering, phase control, and power generation for remotely transmitted and/or received RF signals from the chip antenna according to an example. The IC 310 may be electrically connected to a wiring of the substrate 200 to transmit or receive an RF signal, and may be electrically connected to a ground plane of the substrate 200 to receive a ground.

The adhesive member 320 may bond the IC 310 and the substrate 200 to each other.

The electrical connection structure 330 may electrically connect the IC 310 and the substrate 200. For example, the electrical connection structure 330 may have a structure such as, but not limited to, a solder ball, a pin, a land, a pad, and the like. The electrical connection structure 330 may have a melting point, that is lower than a melting point of a wiring and a ground plane of the substrate 200, and thus may allow the IC 310 and the substrate 200 to be electrically connected to each other through a predetermined process using the low melting point.

The encapsulant 340 may seal at least a portion of the IC 310, thereby improving heat dissipation performance and an impact protection performance of the IC 310. For example, the encapsulant 340 may be provided as a photoimagable encapsulant (PIE), an Ajinomoto build-up film (ABF), an epoxy molding compound (EMC), or the like.

The passive component 350 may be disposed on a lower surface of the substrate 200, and may be electrically connected to a wiring and/or a ground plane of the substrate 200 through the electrical connection structure 330. In an example, the passive component 350 may include at least one among, as non-limiting examples, a capacitor (for example: a multilayer ceramic capacitor (MLCC)), an inductor, and a chip resistor.

The core member 410 may be disposed below the substrate 200, and may be electrically connected to the substrate 200 to receive an intermediate frequency (IF) signal or a baseband signal from an external source to transmit the IF signal or the baseband signal to the IC 310, or to receive an IF signal or a baseband signal from the IC 310 to transmit the IF signal or the baseband signal to an external source. Here, a frequency (e.g., 24 GHz, 28 GHz, 36 GHz, 39 GHz, and 60 GHz) of an RF signal may be greater than a frequency of an IF signal (for example: 2 GHz, 5 GHz, 10 GHz, and the like).

In an example, the core member 410 may transmit an IF signal or a baseband signal to the IC 310, or receive the IF signal or the baseband signal from the IC 310 through a wiring that can be included in an IC ground plane of the substrate 200.

Referring to FIG. 5B, a substrate 200 on which the chip antenna according to an example is mounted may include at least a portion of a shielding member 360, a connector 420, and an end-fire chip antenna 430.

The shielding member 360 may be disposed below the substrate 200, and may be disposed to confine the IC 310 together with the substrate 200. In an example, the shielding member 360 may be disposed to cover (for example, conformal shield) the IC 310 and the passive component 350, or may be disposed to cover (for example, compartment shield) each of the IC and the passive component. In an example, the shielding member 360 may have a hexahedral shape of which one side thereof is open, and may have a hexahedral accommodation space through coupling with the substrate 200. The shielding member 360 may be formed of a material having high conductivity such as copper to have a short skin depth, and may be electrically connected to a ground plane of the substrate 200. Thus, the shielding member 360 may reduce electromagnetic noise that can be received by the IC 310 and the passive component 350.

The connector 420 may have a connection structure of a cable (for example, a coaxial cable, a flexible PCB), may be electrically connected to an IC ground plane of the substrate 200, and may perform a role similar to that of the core member 410 described above. That is, the connector 420 may receive an IF signal, a baseband signal, and/or power from a cable, or may provide the IF signal and/or the baseband signal to the cable.

The end-fire chip antenna 430 may transmit or receive an RF signal in support of the chip antenna module according to an example. In an example, the end-fire chip antenna 430 may include a dielectric block having a dielectric constant greater than that of an insulating layer, and may include a plurality of electrodes disposed on both sides of the dielectric block. One among the plurality of electrodes may be electrically connected to a wiring of the substrate 200, and the other thereof may be electrically connected to a ground plane of the substrate 200.

Figure 6:
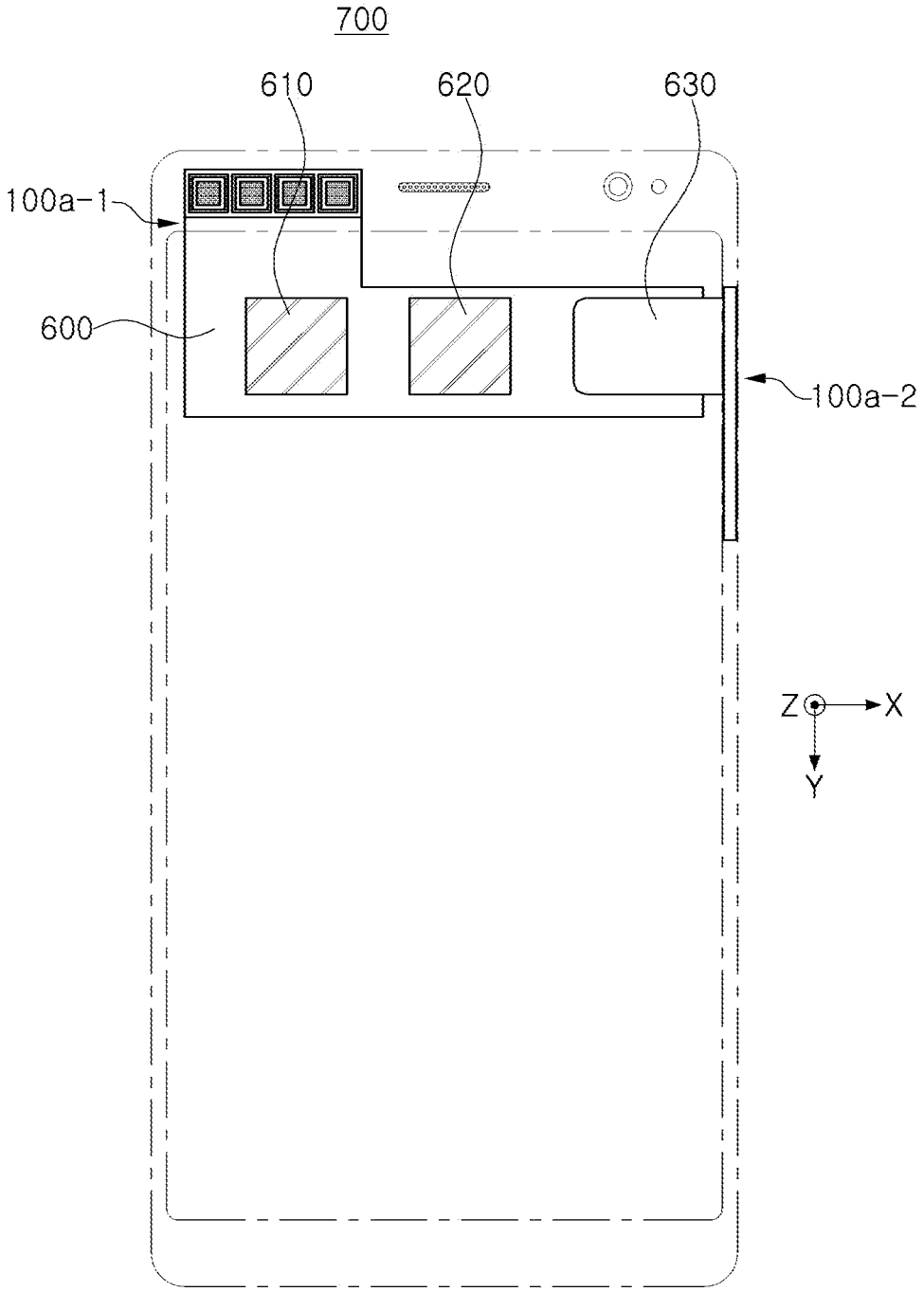
FIG. 6 is a plan view illustrating an arrangement in an example electronic device of a substrate on which an example chip antenna is arranged, in accordance with one or more embodiments.

FIG. 6 is a plan view illustrating an arrangement in an electronic device of a substrate on which a chip antenna according to an example is arranged.

Referring to FIG. 6, a plurality of antenna modules 100*a*-1 and 100*a*-2 according to an example may be disposed adjacent to a plurality of different edges of the electronic device 700, respectively.

The electronic device 700 may be, as non-limiting examples, a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like, but is not limited thereto.

The electronic device 700 may include a base substrate 600, and the base substrate 600 may further include a communication modem 610 and a baseband IC 620.

The communication modem 610 may include at least one among a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphic processor (for example, a graphic processing unit (GPU)), a digital signal processor, a cryptographic processor, a microprocessor, a microcontroller, or the like; and a logic chip such as an analog-to-digital converter (ADC), an application-specific integrated circuit (ASIC), or the like to perform digital signal processing.

The baseband IC 620 may generate a base signal by performing analog-to-digital conversion, amplification for an analog signal, filtering, and frequency conversion. The base signal, input and output from the baseband IC 620, may be transmitted to chip antenna assemblies 100*a*-1 and 100*a*-2 through a coaxial cable, and the coaxial cable may be electrically connected to an electrical connection structure of the chip antenna assemblies 100*a*-1 and 100*a*-2.

In an example, the frequency of the base signal may be in a baseband, and may be a frequency (e.g, several GHz) corresponding to an intermediate frequency (IF). The frequency of the RF signal may be higher than the IF, and may correspond to millimeter waves (mmWave).

The pattern, the via, the plane, the strip, the line, and the electrical connection structure, disclosed herein, may include a metal material (for example, copper (Cu), aluminum (Al), silver (Ag), tin (Sn), gold (Au), nickel (Ni), lead (Pb), titanium (Ti), alloys thereof, or the like), and may be formed using a plating method such as chemical vapor deposition (CVD), physical vapor deposition (PVD), sputtering, subtractive, additive, a semi-additive process (SAP), a modified semi-additive process (MSAP), or the like, but it is not limited thereto.

The RF signal, disclosed herein, may include protocols such as wireless fidelity (W-Fi) (Institute of Electrical and Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth®, 3G, 4G, and 5G protocols, and any other wireless and wired protocols, designated after the abovementioned protocols, but is not limited thereto.

As set forth above, according to an example, a chip antenna may reduce interference between a chip antenna and adjacent antennas by including a filter, and may reduce interference between a communication channel (e.g., 5G communication channel, millimeter wave communication channel) of a chip antenna 100*a* and a communication channel of adjacent antennas (e.g., Wi-Fi, LTE).

According to an example, a chip antenna may have an advantageous structure to be disposed close to each other, such that it is possible to improve a filtering efficiency and an energy efficiency of a filter, and it is possible to reduce the size of the filter.

According to an example, a chip antenna can effectively filter harmonics and/or noise caused by expanding the transmission/reception path while having a data transmission/reception rate by extending the number of transmission/reception paths of the radio frequency (RF) signal, can improve comprehensive gains of the plurality of transmission/reception paths.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna, comprising:

a first dielectric layer;

a second dielectric layer disposed on an upper surface of the first dielectric layer;

a patch antenna pattern disposed in the second dielectric layer;

a first feed via and a second feed via respectively disposed to penetrate through at least one of the first dielectric layer and the second dielectric layer, and electrically connected to a corresponding feed point among a first feed point and a second feed point of the patch antenna pattern; and a first filter and a second filter disposed between the first dielectric layer and the second dielectric layer, and electrically connected to a corresponding feed via among the first feed via and the second feed via.

2. The chip antenna of claim 1, further comprising a first ground layer disposed between the first filter and the second filter and the patch antenna pattern, wherein the first ground layer is configured to have a first hole and a second hole in which the first feed via and the second feed vias are respectively located.

3. The chip antenna of claim 2, further comprising a second ground layer disposed on a lower surface of the first dielectric layer, wherein the second ground layer is configured to have a third hole and a fourth hole in which the first feed via and the second feed via are respectively located.

4. The chip antenna of claim 1, further comprising a ground layer disposed to be spaced apart upwardly or downwardly of the first filter and the second filter; and a first ground via and a second ground via electrically connected between the ground layer and a corresponding filter among the first filter and the second filter.

5. The chip antenna of claim 4, wherein each of the first filter and the second filter comprises a first ring pattern having a first port, and configured to surround a first area; and a second ring pattern having a second port, and configured to surround a second area, wherein one of the first port and the second port is connected to a corresponding feed via among the first feed via and the second feed via, and another of the first port and the second port is connected to a corresponding ground via among the first ground via and the second ground via.

6. The chip antenna of claim 1, wherein each of the first filter and the second filter comprises a first ring pattern having a first port and surrounding a first area; and a second ring pattern having a second port and surrounding a second area, and wherein at least one of the first port and the second port is connected to a corresponding feed via among the first feed via and the second feed via.

7. The chip antenna of claim 6, wherein the first ring pattern and the second ring pattern are disposed to be spaced apart from each other, and have an open shape in a direction facing each other.

8. The chip antenna of claim 6, wherein the first filter is disposed such that the first ring pattern and the second ring pattern protrude from the first port and the second port in a first direction, and the second filter is disposed such that the first ring pattern and the second ring pattern protrude from the first port and the second port in a second direction, different from the first direction.

9. The chip antenna of claim 1, further comprising an adhesive layer configured to adhere between the first dielectric layer and the second dielectric layer.

10. The chip antenna of claim 9, wherein the adhesive layer is configured to have a cavity to surround the first filter and the second filter.

11. The chip antenna of claim 10, wherein the adhesive layer is configured to have a ventilator between the cavity and an outer surface of the adhesive layer.

12. The chip antenna of claim 9, wherein the first dielectric layer and the second dielectric layer are respectively comprised of a ceramic material, and the adhesive layer comprises a polymer.

13. The chip antenna of claim 1, further comprising a soldering pattern disposed on a lower surface of the first dielectric layer and arranged along an outer periphery of the first dielectric layer.

14. An antenna module, comprising a substrate, in which at least one wiring layer and at least one insulating layer are alternately stacked; and a chip antenna disposed on a first surface of the substrate, wherein the chip antenna comprises a first dielectric layer, configured to have a higher dielectric constant than a dielectric constant of the at least one insulating layer;

a second dielectric layer, disposed on an upper surface of the first dielectric layer, and configured to have a higher dielectric constant than the dielectric constant of the at least one insulating layer;

a patch antenna pattern disposed in the second dielectric layer;

a feed via disposed to penetrate through at least one of the first dielectric layer and the second dielectric layer, and electrically connected between the patch antenna pattern and the at least one wiring layer; and a filter, disposed between the first dielectric layer and the second dielectric layer and electrically connected to the feed via.

15. The antenna module of claim 14, wherein the filter comprises a first ring pattern having a first port and surrounding a first area; and a second ring pattern having a second port and surrounding a second area, and wherein at least one of the first port and the second port is electrically connected to the feed via.

16. The antenna module of claim 14, wherein the chip antenna further comprises a ground layer, disposed to be spaced apart upwardly or downwardly of the filter; and a ground via electrically connected between the ground layer and the filter.

17. An electronic device, comprising:

a base substrate comprising:

a communication modem;

a baseband integrated circuit (IC), and at least one antenna module;

the at least one antenna module comprising:

a substrate;

a chip antenna, disposed on an upper surface of the substrate; and an integrated circuit, disposed on a lower surface of the substrate;

wherein the chip antenna comprises:

a first dielectric layer, disposed adjacent to an upper surface of the substrate;

a filter, disposed on an upper surface of the first dielectric layer;

a second dielectric layer disposed above the filter, and a feed via, configured to penetrate the first dielectric layer and the second dielectric layer, and further configured to electrically connect the chip antenna and the integrated circuit, wherein the substrate comprises one or more alternately stacked wiring layers, and one or more alternately stacked insulating layers, and wherein the first dielectric layer and the second dielectric layer are configured to have a higher dielectric constant than a dielectric constant of the insulating layers.

* * * * *